United States Patent [19]

Weeks

[11] Patent Number: 4,807,918

[45] Date of Patent: Feb. 28, 1989

[54] SINGLE LINE GRAPPLE

[75] Inventor: Richard A. Weeks, Slaughter, La.

[73] Assignee: Hawco Manufacturing Co., Slaughter, La.

[21] Appl. No.: 168,915

[22] Filed: Mar. 15, 1988

[51] Int. Cl.[4] ..... B66C 3/10

[52] U.S. Cl. ..... 294/110.1; 294/112; 37/182

[58] Field of Search ..... 294/112, 68.23, 110.1, 294/111; 37/184, 186, 182

[56] References Cited

FOREIGN PATENT DOCUMENTS

| | | | |
|---|---|---|---|
| 13821 | 1/1956 | Fed. Rep. of Germany | 294/111 |
| 603490 | 4/1926 | France | 37/184 |
| 273191 | 4/1951 | Switzerland | 294/68.23 |
| 243801 | 12/1966 | U.S.S.R. | 294/111 |
| 867847 | 9/1981 | U.S.S.R. | 294/68.23 |

*Primary Examiner*—Johnny D. Cherry
*Assistant Examiner*—Gary C. Hoge
*Attorney, Agent, or Firm*—William David Kiesel; Robert C. Tucker; Timothy J. Monahan

[57] ABSTRACT

A single line grapple is provided comprising an upper and lower block operatively connected to a plurality of arms and tines whereby drawing the blocks together closes the tines. The blocks are drawn together by a cable reeved between an upper sheave assembly connected to the upper block and a lower sheave assembly which engages the lower block by interlocking mechanical components. When it is desirable to open the tines, the lower block assembly is disengaged from the lower block. An automatic disengagement feature is provided whereby lowering the grapple to the ground provides enough clearance between the interlocking components for the disengagement feature to operate.

16 Claims, 4 Drawing Sheets

SINGLE LINE GRAPPLE

BACKGROUND OF THE INVENTION

1. Field of the Invention

This invention relates generally to material handling grapples and, more specifically, to grapples which operate while suspended from a single line.

2. Prior Art

A typical prior art grapple comprises an upper block having an upper sheave assembly fixedly attached and a lower block having a lower sheave assembly fixedly attached. A series of arms and tines are pivotally attached to the blocks so that relative vertical movement between the upper and lower blocks opens and closes the tines producing a grasping action.

Two lines from an overhead crane are required to operate the aforementioned prior art grapple. A first line is looped between the upper and lower sheave assemblies to form a pulley. The weight of the grapple suspended from the first line draws the upper and lower block together thereby closing the tines about an object to be raised. The second line is connected to the upper block and is slack when an object is grasped. When the object is to be released, the second line is drawn taut and the first line is played out. When the first line is slack, the weight of the lower block causes it to drop away from the upper block thereby opening the tines.

An obvious shortcoming of the prior art grapple is that it can only be operated by a crane having two independently operable lines from which to suspend a grapple. However, because many loading and unloading facilities, especially maritime facilities, have booms with a single line, there is a need for a single line grapple.

SUMMARY OF THE INVENTION

Therefore, one object of this invention is to provide a grapple which may be suspended and operated by a single line.

Another object of this invention is to provide a single line grapple which can be either manually or automatically tripped open.

Other objects and advantages of this invention shall become apparent from the ensuing description.

Accordingly, a single line grapple is provided comprising an upper block, a plurality of arms connected at one end to the upper block and at an opposite end to a corresponding tine. The tines are pivotally connected to a lower block such that relative vertical movement between the blocks, opens and closes the tines. An upper sheave assembly is connected to the upper block and a lower sheave assembly is operatively connected to the upper sheave assembly by a cable. Means are provided to engage and disengage the lower sheave assembly and the lower block depending on whether it is desired that the tines be closed or open.

PREFERRED EMBODIMENT OF THE INVENTION

Without limiting the scope of the invention, a preferred embodiment of the invention will be described.

Figure 1:
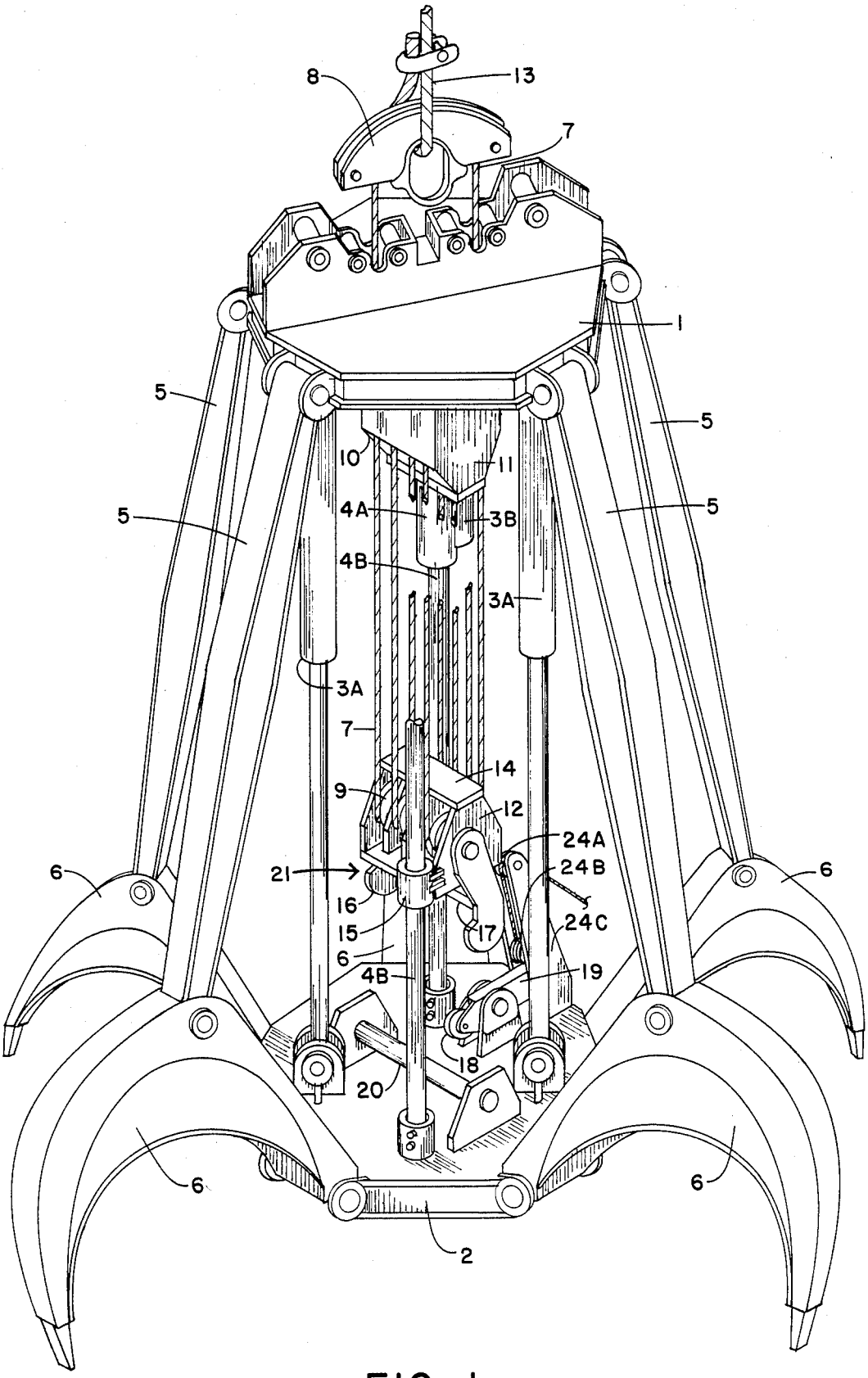
FIG. 1 is a perspective view of the grapple.

Referring to FIG. 1, the skeleton of the grapple comprises upper block 1 which is slidably connected to lower block 2 by guide tubes 4A and guide rods 4B. The grasping mechanism is made up of a plurality of arms 5 each having an end pivotally connected to upper block 1. Tines 6 are claw shaped and have an end pivotally connected to lower block 2. An opposite end of each of arms 5 is pivotally connected to the back of a corresponding tine 6. Hydraulic cylinders 3A are provided to dampen the downward movement of lower block 2 and the opening of tines 6.

It can be seen that relative vertical movement between upper block 1 and lower block 2 opens and closes tines 6. The aforementioned mechanism is well known in the art and has been employed for double line grapples. Those with skill in the art can modify the configuration of arms 5 and tines 6 so that the points of attachment vary. The key aspect of the grasping mechanism is that it opens and closes in response to relative vertical movement between upper block 1 and lower block 2. Furthermore, those with skill in the art will recognize that the mechanical description of the grapple is analogous to a clam shaped bucket used for handling other materials. To the extent that the bucket comprises an upper and lower block pivotally connected to a plurality of arms and jaws wherein relative movement of the blocks closes the jaws, the term grapple is intended to include within its scope a bucket.

Upper block 1 and lower block 2 are drawn together by cable 7 which has two ends hanging from a single yoke 8. Of course, instead of a cable, rope could be used. Each end of cable 7 is looped around lower sheaves 9 and up around upper sheaves 10. Cable 7 is reeved between lower sheaves 9 and upper sheaves 10 enough times to obtain the desired mechanical advantage. Upper sheaves 10 are part of upper sheave assembly 11 which is fixedly connected to upper block 1. Likewise, lower sheaves 9 are part of lower sheave assembly 12. But, rather than being fixedly attached to lower block 2, lower sheave assembly 12 travels on guide rods 4B. Lower sheave assembly 12 has means to engage lower block 2 which will be discussed in detail below. Additionally, at the desired time, lower sheave assembly 12 may be disengaged from lower block 2. In the preferred embodiment of the invention, sheaves are rotatably mounted in the sheave assemblies. Those with skill in the art may substitute other guides for cable 7.

Figure 4:
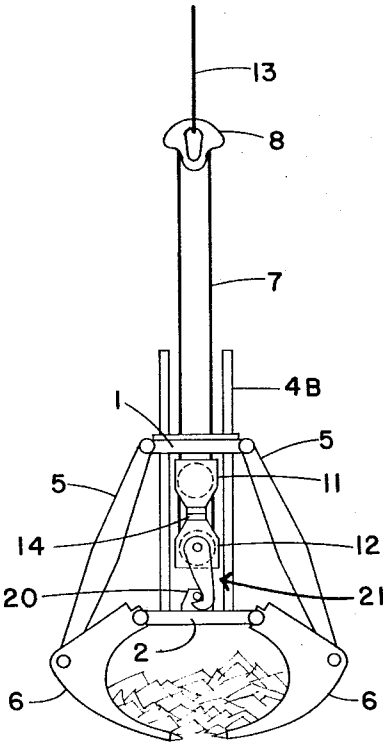
FIG. 4 is a side view schematic of the grapple in closed position.
Figure 3:
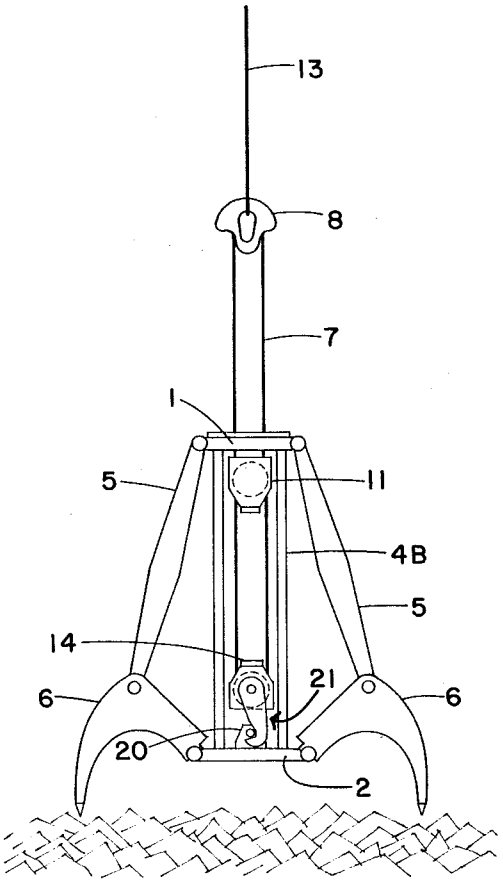
FIG. 3 is a side view schematic of the grapple with the lower sheave assembly engaged.
Figure 2:
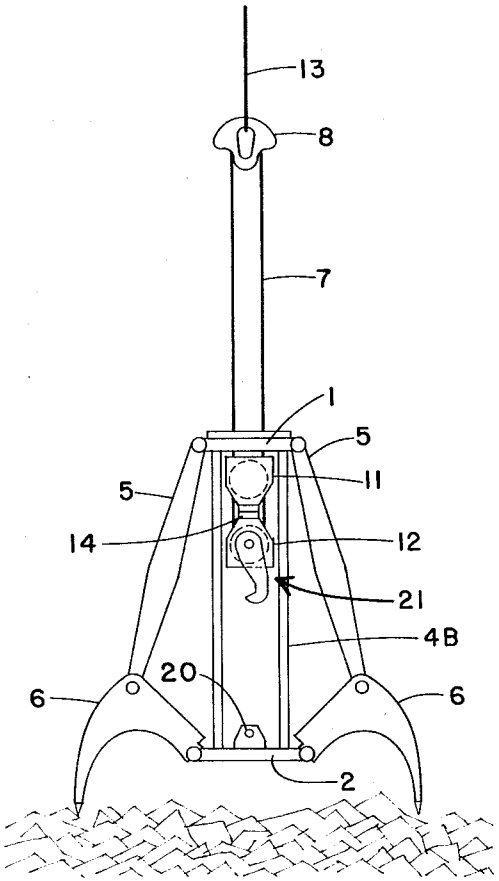
FIG. 2 is a side view schematic of the grapple with the lower sheave assembly disengaged.

The means to disengage lower sheave assembly 12 and lower block 2 allows the grapple to operate from a single suspension line 13. The process by which the grapple closes about and lifts material is illustrated in FIGS. 2–4. FIG. 2 shows lower sheave assembly 12 disengaged from lower block 2. The weight of lower block 2 causes it to slide downward away from upper block 1. As the relative distance between upper block 1 and lower block 2 increases, tines 6 are spread open.

The weight of the grapple is supported by cable 7 which in turn causes lower sheave assembly 12 to be drawn up tight against upper sheave assembly 11. A bumper 14 is interposed between the assemblies to cushion contact. Alignment of lower sheave assembly 12 is maintained by sleeves 15 fixedly attached to the sides of lower sheave assembly 12 as shown in FIG. 1. Sleeves 15 are slidable on guide rods 4B. Additionally, guide tubes 4A and rods 4B help align upper block 1 and lower block 2.

Once tines 6 are open, the grapple can be lowered onto material to be raised as shown in FIG. 3. At this time it is possible to engage lower sheave assembly 12 and lower block 2. Yoke 8 is lowered to provide slack in cable 7. The weight of lower sheave assembly 12 takes up the slack in cable 7 thereby dropping lower sheave assembly 12 onto lower block 2. The mechanism by which lower block 2 is engaged will be discussed below. It is sufficient to understand at this point that in the preferred embodiment the engagement is accomplished by the weight of lower sheave assembly 12 pressing downward against lower block 2.

In FIG. 4, yoke 8 is raised with lower sheave assembly 12 and lower block 2 engaged. As cable 7 is drawn taut, upper block 1 and lower block 2 are drawn together thereby closing tines 6. When lower sheave assembly 12 is drawn up to upper sheave assembly 11, tines 6 are substantially closed. The material can be released and tines 6 opened by disengaging lower sheave assembly 12 and lower block 2. Once lower block 2 is disengaged, it can be seen that the weight of lower block 2 as well as the weight of the material pressing outward on tines 6 will tend to open tines 6. To prevent tines 6 from being flung open, the downward movement of lower block 2 is slowed by hydraulic cylinders 3A. This buffering action is adjustable by restricting the flow of hydraulic fluid into hydraulic reservoir 3B. As shown in FIG. 1, hydraulic reservoir 3B is attached to the side of guide tube 4A.

Figure 5:
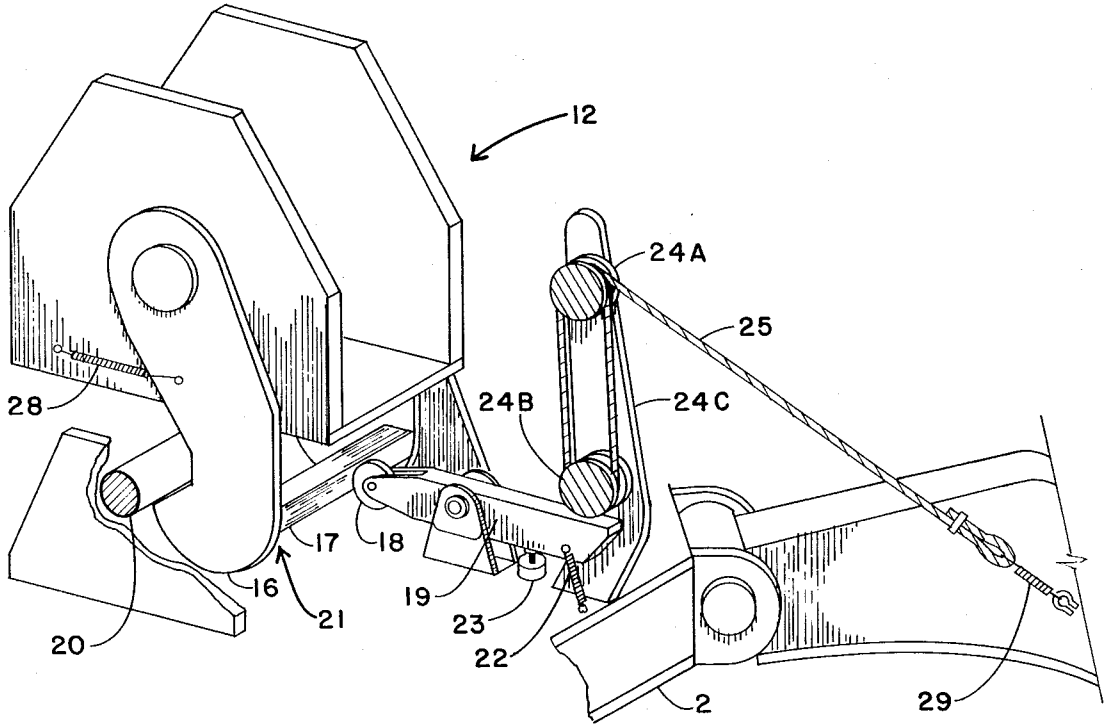
FIG. 5 is a detailed side view of the lower sheave assembly and automatic trip mechanism.

The preferred embodiment of the means to engage lower sheave assembly 12 and lower block 2 is detailed in FIG. 5. Hooks 16 are pivotally connected to both sides of lower sheave assembly 12. Crossbar 17 joins hooks 16 and serves as a backing to interact with trip lever roller 18 of trip lever 19. Hooks 16 and crossbar 17 are designated generally as hook assembly 21. Those with skill in the art can modify hook assembly 21 to accomplish the results described below. In general, the desired features are an elongated extension pendent from lower sheave assembly 12 and a means connected to lower block 2 for clasping the extension when it is lowered into position. As lower sheave assembly 12 is lowered, crossbar 17 depresses trip lever 19 thereby allowing hooks 16 to engage latch pin 20 which is fixedly attached to lower block 2. Hook spring 28 urges hooks 16 into position against latch pin 20 thereby allowing trip lever spring 22 to realign trip lever 19 against trip lever adjustment screw 23. In the aforementioned aligned position, trip lever roller 18 blocks crossbar 17 from swinging and disengaging hooks 16 from latch pin 20. It can be seen that the downward force of lower block 2 has a tendency to displace hooks 16. This force is much greater than the opposite force exerted by hook spring 28 and without trip lever 19 in place, material could not be lifted.

Figure 7:
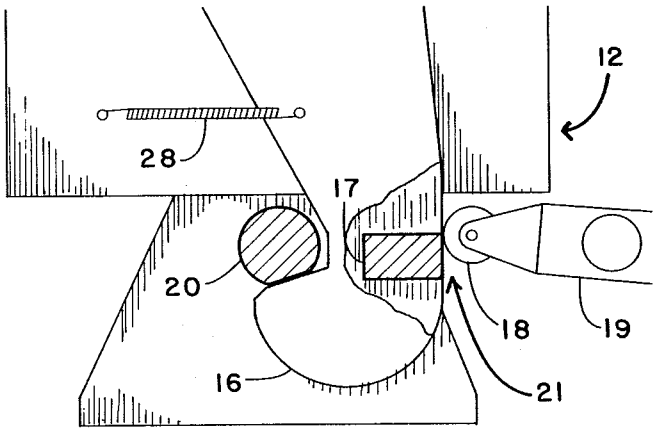
FIG. 7 is a cutaway side view of the hook assembly wedged against the trip lever.

In the preferred embodiment the means to disengage hooks 16 and latch pin 20 works automatically. Referring to FIG. 5, automatic trip cable 25 is reeved between trip pulleys 24A and 24B. Trip pulley 24A is mounted on a stationary pulley support 24C and trip pulley 24B is mounted on trip lever 19 near an end opposite trip lever roller 18. Tension applied to trip cable 25 will tend to draw trip pulleys 24A and 24B together. Pulling trip cable 25 tilts trip lever roller 18 downward thereby allowing hooks 16 to swing away from latch pin 20. The end of trip cable 25 is connected to auto trip spring 29 which is connected to one of tines 6 whereby trip cable 25 is pulled taut as tines 6 close. However, when the grapple is closing or suspended in midair the disengagement means will not automatically trip due to a unique equilibrium between the component parts. This equilibrium is maintained by the downward force of latch pin 20 wedging hook assembly 21 against trip lever roller 18. Trip lever 19 is positioned so that tilting it would cause trip lever roller 18 to travel in an arcuate path intersecting crossbar 17 as shown in FIG. 7. In order for trip lever roller 18 to swing past crossbar 17, lower block 2 and lower sheave assembly 12 must come together thereby allowing hook assembly 21 to pivot towards latch pin 20. In the preferred embodiment, the clearance required is approximately 1/16 of an inch. The force exerted by trip lever roller 18 against crossbar 17 is insufficient to draw lower block 2 and lower sheave assembly 12 together when the grapple is suspended.

Figure 8:
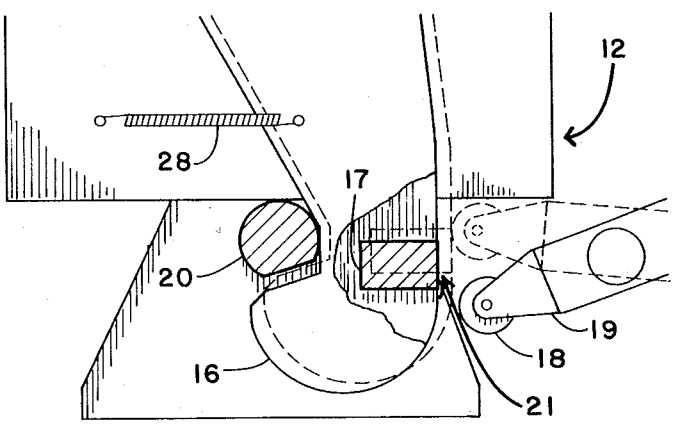
FIG. 8 is a cutaway side view of the hook assembly when the tines are touched down.

The grapple is automatically tripped open by lowering the grapple until the tips of the tine 6 contact the ground or pile of material. Resting the bottom of the grapple on the ground or material creates clearance between the surface of hooks 16 and and latch pin 20 allowing hooks 16 to be forced closer to latch pin 20 as shown in FIG. 8. When hooks 16 are forced closer, trip lever roller 18 is able to swing clear of crossbar 17. Subsequent raising of the grapple disengages hooks 16 from latch pin 20.

Figure 6:
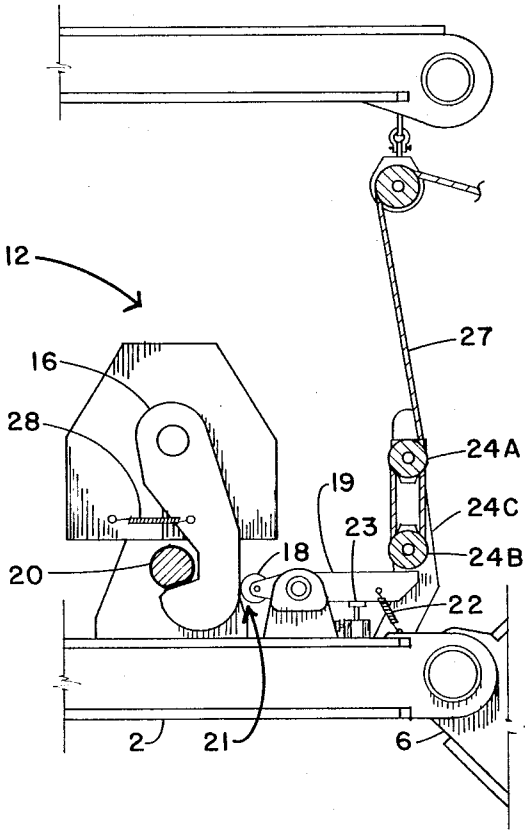
FIG. 6 is a side view of the manual trip mechanism.

FIG. 6 shows an alternative embodiment of the disengaging means. Manual trip cable 27 is reeved between trip pulleys 24 and hung from upper block 1. When it is desired to open the grapple, a person pulls trip cable 27. It is possible to adjust trip lever 19 by raising adjustment screw 23 so that the grapple may be opened in mid-air. With this method the arc travelled by trip lever roller 18 is tangential to the surface of crossbar 17 rather than intersectional.

Other means to releasably engage lower sheave assembly 12 and lower block 2 will become apparent to those with skill in the mechanical arts. Those means and of course obvious alternate embodiments and modifications to this invention are intended to be included with the scope of this invention as defined by the following claims.

What I claim is:

1. A single line grapple comprising:

(a) an upper block;

(b) a plurality of arms, each of sad arms having an end pivotally connected to said upper block;

(c) a lower block vertically aligned beneath said upper block;

(d) a plurality of tines, each of said tines being pivotally connected to said lower block at a first point and pivotally connected to an opposite end of one of said arms at a second point whereby relative vertical movement of said upper block and said lower block opens or closes said tines;

(e) an upper sheave assembly connected to said upper block;

(f) a lower sheave assembly vertically aligned beneath said upper sheave assembly;

(g) a closing cable reeved between said lower sheave assembly and said upper sheave assembly and extending upward from said grapple whereby raising said cable draws said upper sheave assembly and said lower sheave assembly together;

(h) means to engage said lower sheave assembly and said lower block comprising:

(i) a latch pin connected to said lower block;

(ii) a hook assembly, pivotally connected to said lower sheave assembly, having a concave surface for engaging said latch pin;

(iii) a fulcrum connected to said lower block;

(iv) a trip lever mounted on said fulcrum, said trip lever having an end abutting said hook assembly when said hook assembly and said latch pin are engaged;

(v) means connected to said trip lever for urging said trip lever in position to block said hook assembly; and (i) means to disengage said lower sheave assembly and said lower block.

2. A grapple according to claim 1 wherein said hook assembly is wedged against said latch pin and said end of said trip lever when said grapple is raised.

3. A grapple according to claim 2 wherein said end of said trip lever travels in an arc when said trip lever is tilted, said arc intersecting said hook assembly when said hook assembly is wedged against said trip lever.

4. A grapple according to claim 2, wherein said disengaging means comprises a trip cable connected to said trip lever and reeved to tilt said trip lever and allow said hook assembly to pivot away from said latch pin when said cable is manually pulled.

5. A grapple according to claim 3 wherein said disengaging means comprises:

(i) a trip pulley operatively connected to said trip lever;

(ii) a trip cable reeved through said pulley and having an end connected to one of said tines whereby closing said tine biases said trip lever towards a titled position.

6. A grapple according to claim 5 wherein resting said grapple on said tines when said lower sheave assembly and said lower block are engaged forces said lower sheave assembly and said lower block closer together thereby allowing said hook assembly to swing in the direction of said latch pin and allowing said biased trip lever to swing free of said hook assembly.

7. A grapple according to claim 2 further comprising a vertical guide rod having an end connected to said lower block and a sleeve connected to said lower sheave assembly wherein said sleeve is slidable on said rod.

8. A grapple according to claim 2 further comprising a vertical hydraulic cylinder assembly having an end connected to said upper block and an opposite end connected to said lower block, said hydraulic cylinder having a restriction means through which a hydraulic fluid is forced when said blocks move apart.

9. In a grapple having an upper and lower block drawn together by raising a cable reeved through a lower sheave assembly operatively connected to said lower block and an upper sheave assembly connected to said upper block, thereby closing a plurality of tines wherein the improvement lies in a means to open and close said grapple while it is suspended from a single cable comprising:

(i) a means to engage said lower sheave assembly and said lower block comprising:

(i) a latch pin connected to said lower block;

(ii) a hook assembly, pivotally connected to said lower sheave assembly, having a concave surface for engaging said latch pin;

(iii) a fulcrum connected to said lower block;

(iv) a trip lever mounted on said fulcrum, said trip lever having an end abutting said hook assembly when said hook assembly and said latch pin are engaged;

(v) a means connected to said lever arm for urging said trip lever in position to block said hook assembly; and (ii) a means to disengage said lower sheave assembly and said lower block.

10. A grapple according to claim 9, wherein said hook assembly is wedged against said latch pin and said end of said trip lever when said grapple is raised.

11. A grapple according to claim 10, wherein said end of said trip lever travels in an arc when said trip lever is tilted, said arc intersecting said hook assembly when said hook assembly is wedged against said trip lever.

12. A grapple according to claim 10, wherein said disengaging means comprises a trip cable connected to said trip lever and reeved to tilt said trip lever and allow said hook assembly to pivot when said cable is manually pulled.

13. A grapple according to claim 11, wherein said disengaging means comprises:

(i) a trip pulley operatively connected to said trip lever;

(ii) a trip cable reeved through said pulley and having an end connected to one of said tines by a spring whereby closing said tine biases said trip lever towards a titled position.

14. A grapple according to claim 13, wherein resting said grapple on said tines when said lower sheave assembly and said lower block are engaged forces said lower sheave assembly and said lower block closer together thereby allowing said hook assembly to swing in the direction of said latch pin and allowing said biased trip lever to swing free of said hook assembly.

15. A grapple according to claim 10, further comprising a vertical guide rod having an end connected to said lower block and a sleeve connected to said lower sheave assembly wherein said sleeve is slidable on said rod.

16. A grapple according to claim 10, further comprising a vertical hydraulic cylinder having an end connected to said upper block and an opposite end connected to said lower block, said hydraulic cylinder having a restriction means through which a hydraulic fluid is forced when said blocks move apart.

* * * * *